United States Patent [19]

Christen

[11] Patent Number: 4,572,845

[45] Date of Patent: Feb. 25, 1986

[54] PROCESS FOR GLUING WOOD CHIPS AND THE LIKE WITH LIQUID GLUE AND APPARATUS FOR PERFORMING THE PROCESS

[75] Inventor: Werner Christen, Mannheim, Fed. Rep. of Germany

[73] Assignee: Draiswerke GmbH, Mannheim, Fed. Rep. of Germany

[21] Appl. No.: 620,890

[22] Filed: Jun. 15, 1984

[30] Foreign Application Priority Data

Jul. 5, 1983 [DE] Fed. Rep. of Germany ..... 3324106

[51] Int. Cl.[4] ..... B05D 7/00

[52] U.S. Cl. ..... 427/212; 427/242; 118/303

[58] Field of Search ..... 427/212, 242, 424; 118/303, 19

[56] References Cited

U.S. PATENT DOCUMENTS

| | | | |
|---|---|---|---|
| 2,601,355 | 6/1952 | Wyss et al. | 118/303 X |
| 3,101,040 | 8/1963 | Lanz | 118/303 X |
| 3,390,648 | 7/1968 | Martin | 118/19 X |
| 3,877,415 | 4/1975 | Blouin | 118/303 |
| 4,188,130 | 2/1980 | Engels | 366/288 |
| 4,478,171 | 10/1984 | Bridges et al. | 118/303 X |

*Primary Examiner*—Shrive P. Beck

*Attorney, Agent, or Firm*—Laff, Whitesel, Conte & Saret

[57] ABSTRACT

In an apparatus for the continuous gluing of wood chips and the like with liquid glue, the chips are raised from a longitudinally moved chip bed and are returned into the same in free fall in the form of chip mists. The glue is exclusively supplied to the chips by pressure atomization by means of a plurality of pressure atomizing nozzles.

In order to achieve good gluing quality with limited mixer dirtying and easy operation, glue distribution takes place in the chip mists substantially over the entire length of the chip bed and alternately at least one nozzle is closed, while at least one nozzle is open.

3 Claims, 3 Drawing Figures

PROCESS FOR GLUING WOOD CHIPS AND THE LIKE WITH LIQUID GLUE AND APPARATUS FOR PERFORMING THE PROCESS

FIELD OF THE INVENTION

This invention relates to a process for the continuous gluing of wood chips and the like with glue, the chips being raised from a longitudinally movable chip bed and returned thereto in free fall in the form of chip mists. The invention also relates to an apparatus for performing the process above referred to.

BACKGROUND OF THE INVENTION

Large area wood chips, so-called wafers or strands, are preferably glued in free fall or gravity gluing mixers, in which a cylindrical mixing drum rotatable about its central longitudinal axis is provided with an inlet aperture for the wood chips in one end wall and an outlet aperture for the glued wood chips in the other end wall. On the inner wall of the mixing drum are provided shovel-like plates by means of which chips are raised from a wood chip bed in the inner area of the mixing drum and are returned in free fall to the latter in the form of a relatively thin layer. Such an apparatus is disclosed, for example, in U.S. Pat. No. 4,188,130. Generally, no gluing problems are encountered when the chips are glued with powdered glue. Various processes exist for gluing chips with liquid glue, which is being ever increasingly used and they in part suffer from serious shortcomings with respect to handling, uniformity of the glue distribution on the chips (gluing quality), dirtying of the mixer and operating costs. Thus, it is known to provide pressure or rotary spray nozzles on the end wall having the inlet aperture. This arrangement leads to a poor gluing quality because only a limited chip surface is sprayed with glue. In addition, the mixer is made very dirty, because all the glue is fed in at the beginning of the mixing drum.

It is also known in this connection to supply liquid glue by means of rotary deflectors, whereof one is arranged on the end wall having the inlet aperture and another on the end wall having the outlet aperture. Although the degree of dirtying of the mixer is satisfactory, the gluing quality varies, which leads to increased glue consumption.

Finally, it is also known to distribute liquid glue in a pressureless manner by means of two-fluid nozzles, i.e. together with compressed air. The gluing quality is good, but the mixer becomes very dirty.

SUMMARY OF THE INVENTION

The object of the present invention is to provide a process and an apparatus of the aforementioned type, which lead to a good gluing quality, accompanied by low dirtying of the mixer and easy operation.

According to one aspect of the invention, there is provided a process for the continuous gluing of wood chips and the like with liquid glue, the chips being raised from a longitudinally movable chip bed and returned thereto in free fall in the form of chip mists, the glue being exclusively supplied to the chips by pressure atomization by means of a plurality of pressure atomizing nozzles, wherein the glue distribution takes place in the chip mists substantially over the entire length of the chip bed. It is essential to the invention that the liquid glue is introduced into the mixing drum by means of a plurality of pressure nozzles, the latter being so widely distributed over the length thereof in the axial direction, that uniform gluing quality is achieved. In the case of pressure atomization alone, a spatially very accurately defined spraying of the glue is possible, so that the latter is completely applied to the chips, i.e. does not strike against other physical objects, such as e.g. parts of the machine. Thus, the mixer is only subject to very limited dirtying.

However, pressure atomization alone by means of conventional pressure atomizing nozzles only leads to the desired very fine division of the glue, if the glue pressure remains within predetermined pressure ranges, which are dependent on the nozzle design. As mixers are operated over large chip quantity ranges per unit of time and consequently there is also a considerable variation in the glue flow rate per unit of time in the case of conventional proportional settings, this leads to large fluctuations of the glue pressure with a corresponding reduction of the fineness of glue atomization. These problems can be overcome if alternately at least one nozzle is closed whilst at least one other nozzle is open. At least in the partial load range, on the basis of a cascade system, alternately at least one nozzle is placed out of operation for a certain time. As each nozzle is only not supplied with glue for a short time, it is on the one hand ensured that the nozzles in operation are subject to the optimum pressure, and on the other hand the one or more nozzles which are not required cannot clog as a result of hardening glue.

In a further development, as a function of predetermined minimum and maximum glue pressure, at least one nozzle is additionally closed or opened. This arrangement ensures that during large flow rate fluctuations and during operating problems, particularly through the clogging of a nozzle, working always takes place with an optimum glue pressure upstream of the nozzles.

Another aspect of the present invention provides an apparatus for performing the above-described process, said apparatus comprising a cylindrical mixing drum rotatable about its central longitudinal axis, said drum having an inlet aperture for the wood chips in one end wall and an outlet aperture for the wood chips coated with glue in the other end wall, means for raising wood chips from a chip bed in the mixing drum and pressure atomizing nozzles for spraying glue onto the chips in the interior of the mixing drum, wherein the nozzles are distributed substantially over the entire length of the mixing drum and are directed in a region of the said interior of the mixing drum having an upwardly directed rotation direction.

Preferably, a controllable valve is connected upstream of each nozzle and a regulating-control unit is provided for the alternate opening and closing of the nozzles.

The nozzles are desirably fitted to glue supply pipes, said pipes being fitted to at least one carriage movable relative to the mixing drum in the direction of the longitudinal axis thereof.

BRIEF DESCRIPTION OF THE DRAWINGS

The invention will now be further described, by way of example, with reference to the drawings, in which.

Figure 1:
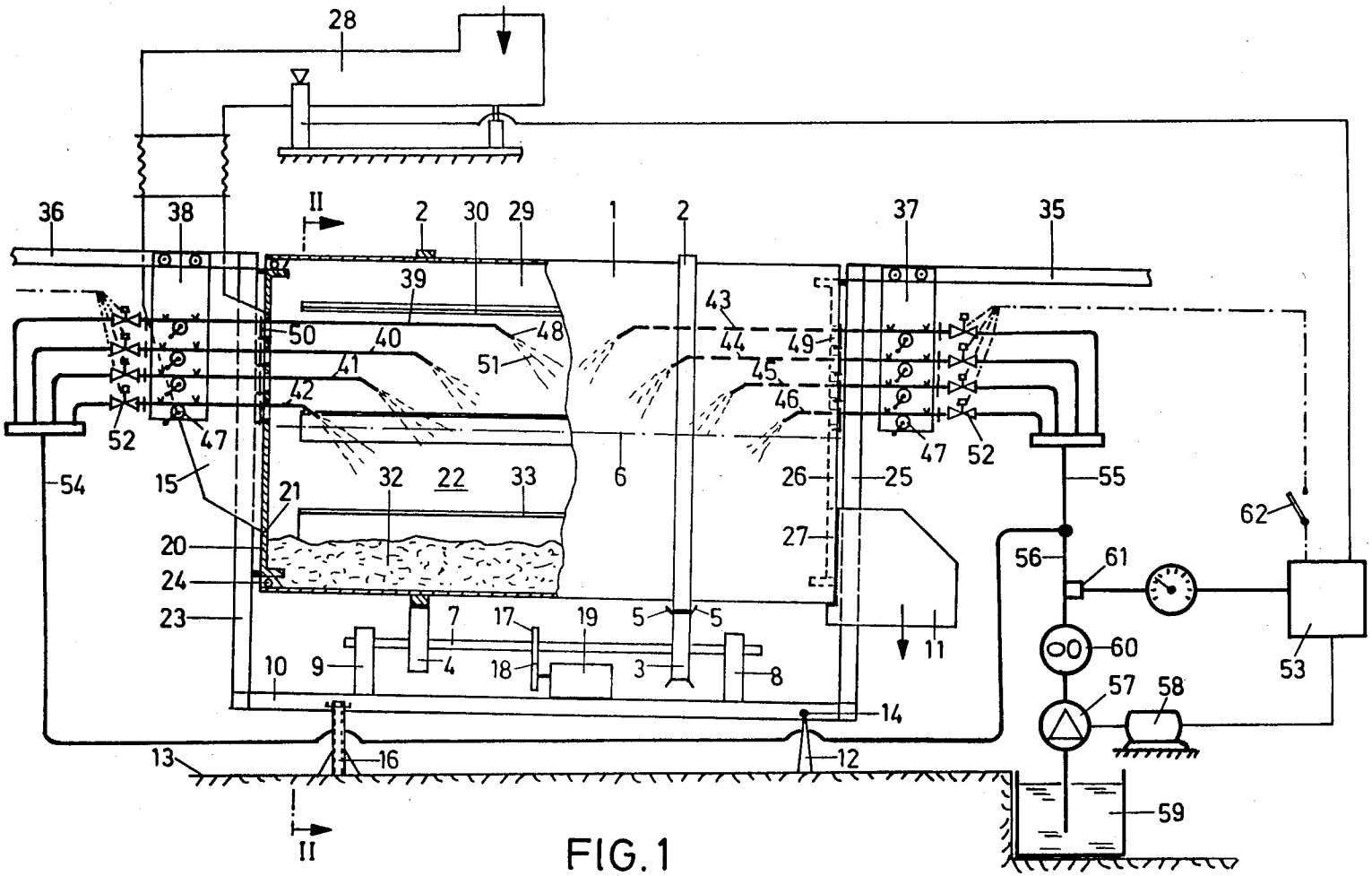
FIG. 1 is a vertical side view of an apparatus according to the invention in diagrammatic, partly broken away form.

DETAILED DESCRIPTION OF THE PREFERRED EMBODIMENT.

The apparatus shown in the drawings has a cylindrical mixing drum 1, which has a comparatively large diameter of approximately 1 to even 3 meters. It is provided around its outer periphery with support rings 2 extending all around it, these support rings being associated pairwise with support rollers 3, 4. A pair of support rollers 3 located in one radial plane and associated with a support ring 2 is provided with guide rings 5 which laterally engage round the associated support ring 2, so that the mixing drum 1 is non-displaceably mounted on support rollers 3, 4 in the direction of its central longitudinal axis 6. The support rollers 3, 4, each of which is arranged on one side, are non-rotatably mounted on a common shaft 7, which is in turn mounted on pedestals 8, 9. The latter are mounted on a base frame 10, which is mounted at one end, namely the end adjacent to an outlet chute 11 of the mixing drum 1, with respect to the floor 13 by means of a pivot 12, the swivelling axis 14 of said base frame running horizontally and perpendicularly to the central longitudinal axis 6. At its other end adjacent to an inlet chute 15, the base frame is supported on both sides with respect to the floor 13 by means of threaded spindles 16, so that the angle of the mixing drum 1 can be altered in an angular range between 0° and 4° relative to the horizontal, in such a manner that the mixing drum 1 can be tilted slightly downwards from the inlet chute 15 to the outlet chute 11.

One of the two shafts 7 is provided in its central area with a sprocket 17, which can be driven by means of a chain 18 by a drive motor 19 mounted on the base frame 10, so that as a result, the mixing drum 1 can be rotated.

The end of the mixing drum 1 facing the inlet chute 15 is closed by a circular end wall 20, on which the inlet chute 15 is mounted, with an associated inlet aperture 21 in said end wall 20 providing a passage into the interior 22 of the mixing drum 1. The inlet chute 15 and hence the end wall 20 is supported relative to the base frame 10 by means of supports 23 so that the end wall 20 is fixed relative to the base frame 10 and does not rotate with the mixing drum 1. Profiled joints 24 are provided on its periphery, which joints provide a substantially dustproof seal between the end wall 20 and mixing drum 1.

An end wall 26 is provided in front of the end wall associated with the outlet chute 11, which wall is also supported on the base frame 10 by means of supports 25 and does not rotate with the mixing drum 1. The end wall 26 has an outlet aperture 27 providing a passage into the outlet chute 11 which is firmly mounted on this end wall 26.

The inlet chute 15 is located upstream of a weighing mechanism 28, e.g. a conveyor-type weigher, which is shown schematically in the drawing and which is in turn associated with a not shown, volumetrically dispensing delivery device of a hopper. This weighing mechanism 28 has a gravimetrically operating control device and this device and the upstream-located, volumetrically dispensing delivery device of the hopper are connected to a control circuit so that a continuous stream of wood chips in a precisely preset quantity of weight per unit time is fed in the mixing drum 1 through the inlet chute 15. The aforementioned dispensing devices are traditional and generally known.

Figure 2:
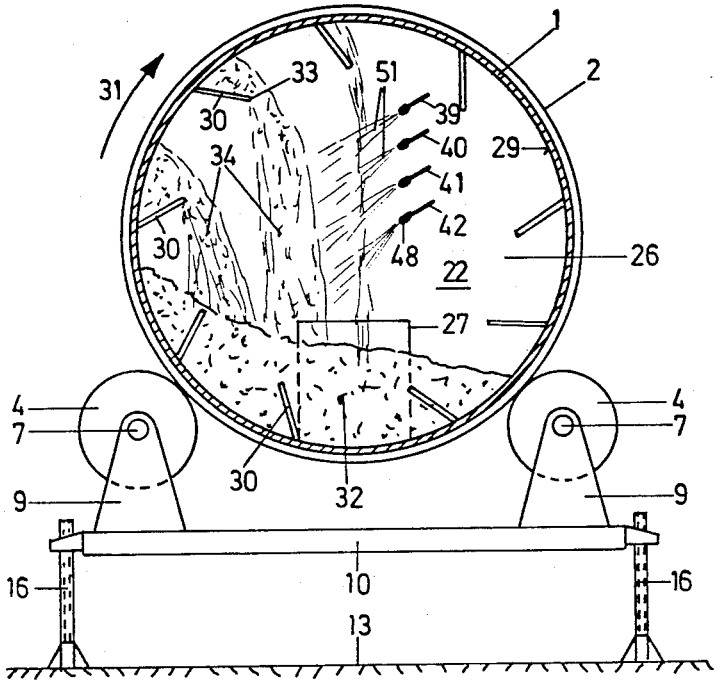
FIG. 2 is a section taken on the line II—II in FIG. 1 in the direction of the arrows.

Lifting flights 30, extending parallel to the longitudinal axis 6, are provided on the inner wall 29 of the mixing drum 1. These lifting flights 30 mainly extend radially, but are directed somewhat towards the inner wall 29 in the rotation direction 31 of the mixing drum 1. During the rotation of the mixing drum 1, whose circumferential speed is in the range 0.5 to 3 m/s and preferably 0.6 to 2 m/s, the lifting flights 30 scoop up wood chips from a wood chip bed 32 located in the lower region of the drum 1. During the movement of the particular lifting flight 30, these wood chips flow upwards in the rotation direction 31 over the radially inner edge 33 of the particular flight 30 in the form of a relatively thin chip mist 34 back into the wood chip bed 32. As can be gathered from FIG. 2, during the lifting movement of the particular lifting flight 30, such chip mists pass at right angles through the mixing drum 1 roughly to the centre thereof.

At the upper ends of the supports 23, 25 are provided cantilever-like guide rails 35 or 36 extending parallel to the longitudinal axis 6 and on which in each case a carriage or trolley 37 or 38 is displaceably arranged. A plurality of glue supply pipes 39, 40, 41, 42 and 43, 44, 45, 46, in the form of so-called nozzle lances which are also parallel to the longitudinal axis 6, are individually detachably fixed by means of a clamping mechanism 47 to each carriage 38 or 37. With the particular carriage 38 or 37, each glue supply pipe 39 to 46 can be moved into or out of the mixing drum 1. At the free end of each glue pipe which is located in the inner area 22 of the mixing drum 1 is carried a pressure atomizing nozzle 48, the nozzles 48 of pipes 39 to 42 and 43 to 46 being staggered relative to one another in the axial direction, i.e. they are successively arranged. The particular glue supply pipes with their nozzles 48 are introduced through corresponding openings 49 in the end walls 20 or 26 into the inner area 22 of the mixing drum 1. The particular glue supply pipes 39 to 46 are then joined to the particular end wall 20 or 26 by means of detachable fixing devices 50. As can be gathered from FIG. 1, in this position the nozzles 48 are roughly uniformly distributed over the length of the mixing drum 1. As can be gathered from FIG. 2, the nozzles are arranged in the upper following quadrant with respect to the rotation direction 31, and said nozzles spray glue into the chip mist 34 mainly trickling down the upper first quadrant and the lower first quadrant, the average direction of this glue spray cone 51 being downwardly inclined by approximately 30° to 45° relative to the horizontal.

Upstream of each glue supply pipe 39 to 46 is provided a respective motor-adjustable, particularly pneumatically adjustable valve 52, which is operated from a central regulating-control unit 53. The glue supply pipes 39 to 42 on the one hand and 43 to 46 on the other hand arranged at respective ends of the mixing drum 1 and associated in each case with a respective carriage 38 or 37 are supplied with glue from a central glue supply line 56 by means of respective flexible glue branch lines 54, 55. Glue is supplied by means of a glue pump 57, which is driven by a speed-regulated direct current motor 58. The glue pump 57 takes the glue from a storage container 59. Following the glue pump 57 in the glue supply line 56, a glue volume measuring device 60, e.g. an oval wheel counter, is provided which measures the actual value of the glue volume supplied to the nozzles 48 per unit of time and supplies this value to the regulating-control unit 53. The weighing mechanism 28 supplies the actual value of the chip weight quantity supplied to the mixing nozzle 1 per unit of time to the regulating-control unit 53. If the preset glue quantity relative to the chip quantity is not correct, then by means of a desired-actual value comparison, the glue pump 57 is automatically readjusted to the preset desired value by means of the direct current motor 58. The line 56 also contains a pressure transducer 61, which supplies the actual glue pressure value to the regulating-control unit 53 and has both a pressure display and conventional minimum and maximum contacts.

The apparatus can be automatically operated by means of the regulating-control unit 53. However, it can also be switched over to manual operation, the valves 52 then being opened or closed by means of hand switches.

Operation takes place in the following manner. Nozzles 48, which have a conventional construction, give optimum glue atomization only in a predetermined pressure range, which is indicated as pmin and pmax in the upper graph of FIG. 3. If the glue pressure is within this range, nozzles 48 bring about a good atomization.

In the manner shown in the drawing, the apparatus is designed in such a way that based on the maximum chip flow rate for the plant size, in each case six nozzles are in operation, whilst two are switched off. To prevent hardening of the glue in the nozzles or the associated glue supply pipes which would lead to clogging, one nozzle is switched on and another is switched off in turn so that in a cascade system each nozzle is operated once within a predetermined time interval.

Figure 3:
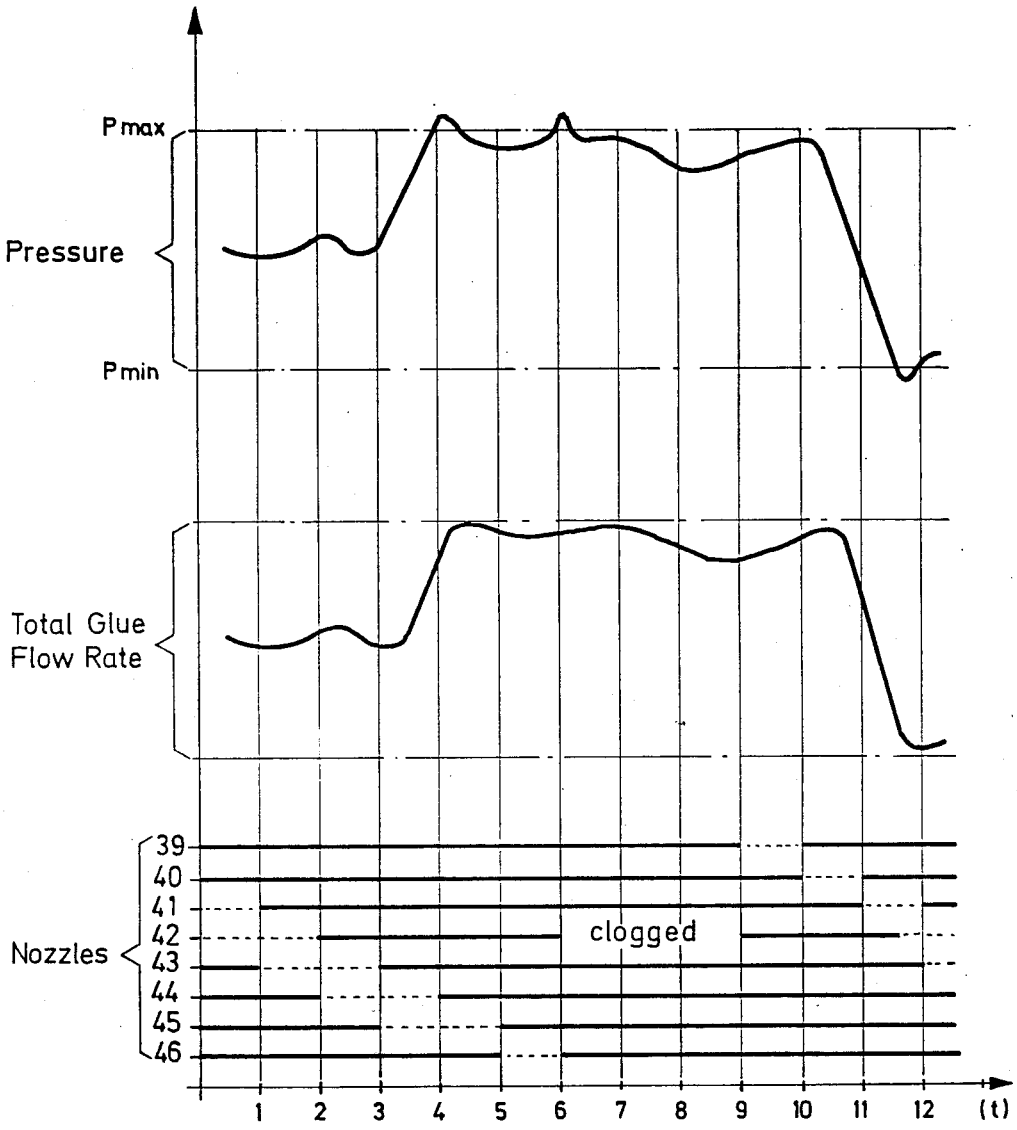
FIG. 3 illustrates the operation of the apparatus in the form of graphs in which the glue pressure, the glue flow rate and the opening and closing of the individual nozzles which are associated with one another are plotted against time.

The central graph of FIG. 3 shows the total glue flow rate per unit of time and which is readjusted in accordance with the chip quantity flow rate determined.

The lower graph of FIG. 3 shows which nozzles are open or closed, the numbers of the associated glue supply pipes 39 to 46 being given for identifying nozzles 48. As stated, the opening and closing of the nozzles 48 takes place by an opening or closing of the respective upstream-connected valve 52.

Initially, at the beginning of the graphs depicted in FIG. 3, there is a glue flow rate in which the pressure is between pmin and pmax with two nozzles closed and six nozzles open. Thus, in this case, the nozzles 39, 40 and 43 to 46 are open, whilst the nozzles 41, 42 are closed. In accordance with the cascade system, at time t1, the nozzle 41 opens and nozzle 43 closes, at time t2, the nozzle 42 opens and nozzle 44 closes, and at time t3, the nozzle 43 opens and nozzle 45 closes. As a result of a corresponding rise of the glue flow rate at time t4, there is such a pressure rise that pmax is exceeded, so that one of the two nozzles acting as reserve nozzles is additionally opened. Thus, in the present case, this means that at time t4, the nozzle 46 remains open instead of being closed, so that 7 and not 6 nozzles are open. Only when the nozzle 45 opens at time t5 does the nozzle 46 close. At time t6, the nozzle 39 should close again, but at this instant there is an operating fault, so that a pressure rise occurs in the system, because the line 42 is clogged. Glue consumption is relatively high, in the time from time t6 to t9 following this fault, so that a reserve nozzle is required, i.e. 7 nozzles in all, during this time period whereby all of the operational nozzles are always open. The glue supply pipe 42 can be replaced during this time period without any interruption to the operation of the apparatus. At time t9, the clogged nozzle 42 is replaced and once again the cascade system is operated, i.e. the nozzle 39 is closed. At time t10, the nozzle 39 is opened and the nozzle 40 closed. During the time between t10 and t11, the glue flow rate drops to such an extent as a result of a chip flow rate reduction, that the pressure falls below pmin with the consequence that the nozzle 42 is prematurely closed. As stated hereinbefore, the system continues to operate in such a way that in each case two nozzles are closed, so that once again the pressure rises above pmin.

If, as described hereinbefore, the pressure rises without there being any increase in the glue flow rate, this is a sign that a nozzle is clogged. In this case, automatic operation is switched off and there is a change to manual operation and by means of the corresponding hand switch 62, a nozzle 48 of a glue supply pipe 39 to 46 is switched on or off and a pilot light shows which valve 52 is closed. The nozzle undergoing no pressure change during switching on and off is clogged and can be replaced without interrupting operations, as stated hereinbefore. It has been found that a pressure range of 40 bar (corresponding to 200 to 400N $mm^2$) is the range in which good spraying takes place. The glue viscosity should not exceed 100 cP. (This applies for conventional glues, such as phenol or urea glues. However, consideration can also be given to binders, which are sprayed in higher pressure ranges, such as e.g. isocyanate or melamine binders.)

In the aforementioned free fall mixer, the glue distribution on the individual chips takes place substantially exclusively by the pressure atomization of the glue. There is no smearing of the glue on the individual chips due to rubbing of the chips against one another, because there are no significant frictional forces between the chips. Very accurately defined glue spray cones 51 can be obtained through pressure atomization without the addition of air, so that the glue can be applied to the chips in a clearly defined manner and specifically in chip mists 34 and the wood chip bed 32. By maintaining predetermined pressure ranges, there is an optimum fine atomization and consequently a uniform gluing of the chips. The glue supply pipes can be set in an optimum manner with respect to the chip mists by rotation about their longitudinal axis.

What is claimed is:

1. A process for the continuous gluing of wood chips with liquid glue, the chips being raised from a longitudinally movable chip bed and returned thereto in free fall in the form of chip mists, the glue being exclusively supplied to the chips by pressure atomization by means of a plurality of pressure atomizing nozzles, and the glue distribution taking place in the chip mists substantially over the entire length of the chip bed, wherein alternately at least one nozzle is closed, whilst at least one other nozzle is open, the alternate opening and closing of the nozzles taking place at predetermined time intervals.

2. A process for the continuous gluing of wood chips with liquid glue, the chips being raised from a longitudinally movable chip bed and returned thereto in free fall in the form of chip mists, the glue being exclusively supplied to the chips by pressure atomization by means of a plurality of pressure atomizing nozzles, and the glue distribution taking place in the chip mists substantially over the entire length of the chip bed, wherein at least one nozzle is closed, whilst at least one other nozzle is open, and wherein as a function of pre-determined minimum and maximum glue pressure, at least one nozzle is additionally closed or open.

3. A process as claimed in claim 2, in which alternately at least one nozzle is closed, whilst at least one other nozzle is open.

* * * * *